United States Patent [19]

Stewart

[11] 4,262,745

[45] Apr. 21, 1981

[54] STEAM STIMULATION PROCESS FOR RECOVERING HEAVY OIL

[75] Inventor: Norman E. Stewart, Grand Centre, Canada

[73] Assignee: Exxon Production Research Company, Houston TX

[21] Appl. No.: 103,803

[22] Filed: Dec. 14, 1979

[51] Int. Cl.[3] ..... E21B 43/24

[52] U.S. Cl. ..... 166/263; 166/303

[58] Field of Search ..... 166/263, 303, 272, 302

[56] References Cited

U.S. PATENT DOCUMENTS

| | | | |
|---|---|---|---|
| 3,259,186 | 7/1966 | Dietz | 166/263 |
| 3,294,167 | 12/1966 | Vogel | 166/272 |
| 3,434,544 | 3/1969 | Satter et al. | 166/303 |
| 4,109,723 | 8/1978 | Widmyer | 166/263 X |

OTHER PUBLICATIONS

Bleakley, "Well-Bore Heat Losses", The Oil & Gas Journal, vol. 63, No. 10, Mar. 8, 1965, pp. 162, 164.

Farouq Ali, et al., "Current Steamflood Technology", Journal of Petroleum Technology, Oct. 1979, pp. 1332–1342.

*Primary Examiner*—Stephen J. Novosad

[57] ABSTRACT

A method for steam stimulating a heavy oil reservoir which realizes significant energy savings is disclosed. Steam is injected into the reservoir via one well, permitted to soak and then produced back directly into the reservoir via a second well. This flowback steam production is terminated when wellhead pressures equalize, or when more than trace amounts of hydrocarbons are produced. Additional steam is injected into the reservoir via the second well, permitted to soak, and heated heavy oil is produced via both wells.

12 Claims, 1 Drawing Figure

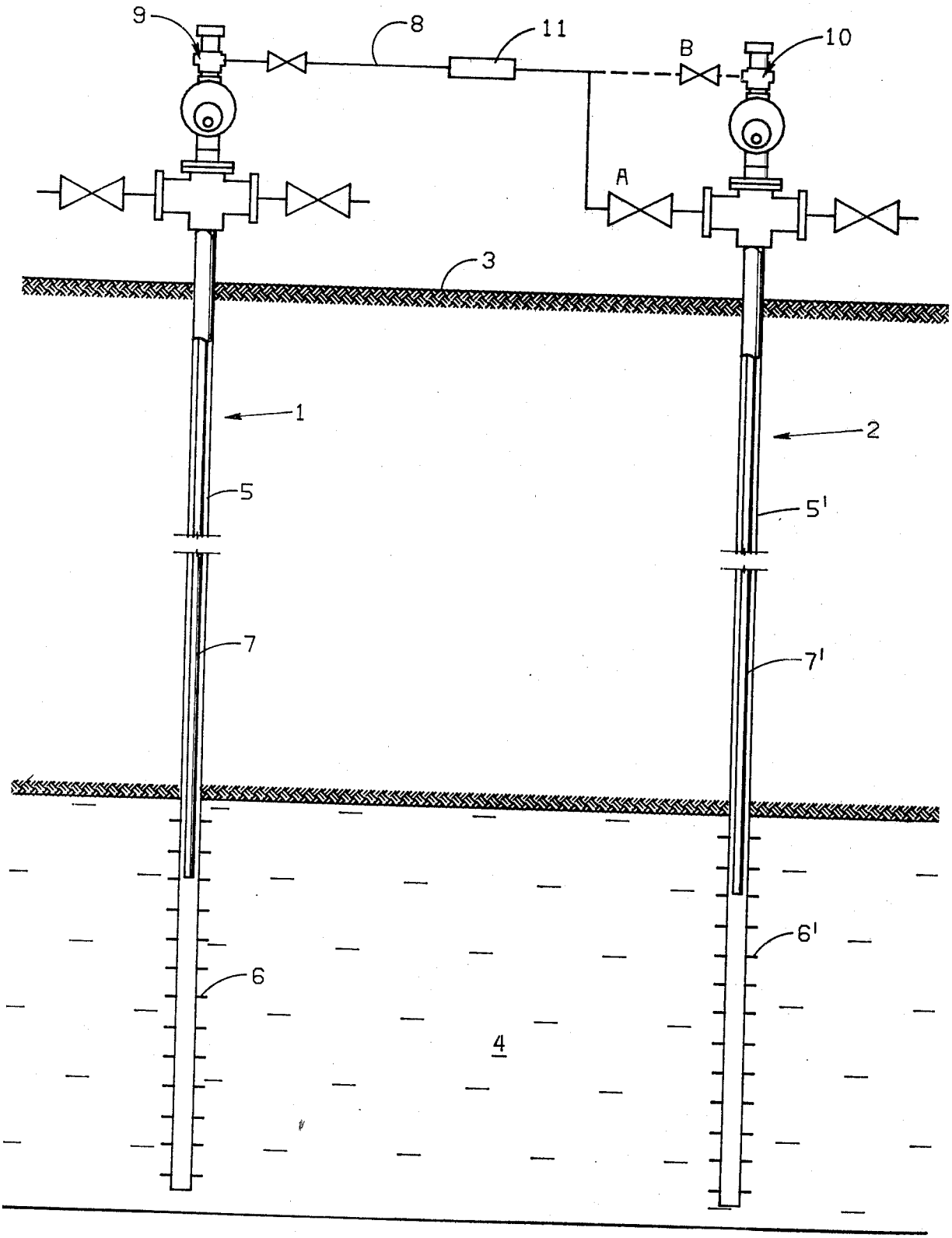
9
8
11
B
10
A
3
1
2
5
5'
7
7'
6'
6
4

STEAM STIMULATION PROCESS FOR RECOVERING HEAVY OIL

BACKGROUND OF THE INVENTION

1. Field of the Invention

This invention relates to a process for extracting hydrocarbons from the earth. More particularly, this invention relates to a method for recovering viscous hydrocarbons such as bitumen from a subterranean reservoir by injecting steam via a well into the reservoir to lower the viscosity of the hydrocarbon thereby stimulaing production.

2. Description of the Prior Art

In many area of the world, there are large deposits of viscous petroleum, such as the Athabasca and Cold Lake region in Alberta, the Jobo region in Venezuela and the Edna dnd Sisquoc regions in California, U.S.A. These deposits are often referred to as "tar sand" or "heavy oil" deposits due to the high viscosity of the hydrocarbons which they contain. While some distinctions have arisen between tar sands (viscosity between about 10,000 and 100,000 cp @ reservoir temperature) and heavy oil (viscosity between about 1,000 and 10,000 cp @ reservoir temperature), these terms will be used interchangeably herein. These tar sands may extend for many miles and occur in varying thicknesses of up to more than 300 feet. Although these deposits may lie at or near the earth's surface, generally they are located under a substantial overburden which may be as great as several thousand feet thick. Tar sands located at these depths constitute some of the world's largest presently known petroleum deposits. The tar sands contain a viscous hydrocarbon material, commonly referred to as bitumen, in an amount which ranges from 5 to about 20% by weight. Bitumen is normally immobile at typical reservoir temperatures. For example, in the Cold Lake region of Alberta, at a typical reservoir temperature of about 55° F., bitumen is immobile with a viscosity exceeding several thousand poises. However, at higher temperatures, such as temperatures exceeding 200° F., the bitumen generally becomes mobile with a viscosity of less than 345 centipoises.

Since most tar sand deposits are too deep to be mined economically, various in situ recovery processes have been proposed for separating the bitumen from the sand in the formation itself and producing the bitumen through a well drilled into the deposit. Among the various methods for in situ recovery of bitumen from tar sands, processes which involve the injection of steam are generally regarded as most economical and efficient. Steam can be utilized to heat and fluidize the immobile bitumen and, in some cases to drive the mobilized bitumen towards production means.

The most common and proven method for recovering viscous hydrocarbon is by using steam stimulation techniques which involve heating a formation in the vicinity of a well to stimulate production back through the same well. In this type of process, steam is injected into a formation by means of a well and the well is shut-in to permit the steam to heat the bitumen, thereby reducing its viscosity. Subsequently, all formation fluids, including mobilized bitumen, water and steam, are produced from the same well using accumulated reservoir pressure as the driving force for production.

The primary objective of a steam stimulation process is to transfer thermal energy into the formation and permit the rock to act as a heat exchanger. This heat then lowers the viscosity of the oil flowing through the heated volume. Normally, water-oil ratios are extremely high when the well is first returned to production, but the amount of water (and steam) produced declines and the oil production rate passes through a maximum that is usually much higher than the original rate.

Initially, sufficient pressure may be available in the vicinity of the wellbore to lift fluids to the surface; as the pressure falls, artificial lifting methods are normally employed. Production is terminated when no longer economical and steam is injected again. This cycle is then repeated many times until oil production is no longer economical.

During the early cycles of steam injection and production, oil production rates may be quite high since the oil nearest to the well is being produced. However, during subsequent steam cycles as the oil nearest the well is depleted, steam must move farther into the formation to contact the oil and as a result increased heat losses make the steam less effective as an oil recovery agent. The process loses efficiency with each cycle and eventually oil production becomes uneconomic. This is often simply because it costs more to generate the steam than any additional oil recovered in a cycle.

In steam stimulation processes the highest pressures and temperatures exist in the vicinity of the well immediately following the injection phase. Normally, this pressure and temperature will correspond to the properties of the steam which was employed. Before oil can be moved from the remote parts of the reservoir to the well, the pressure in the near well regions must fall so that it is lower than the distant reservoir pressure. During this initial depressurizing phase, the near wellbore reservoir material cools down as water flashes into steam. As mentioned, the first production from the well thus tends to be steam and this tends to be followed by hot water. Eventually, the pressure is low enough and oil can move to the wellbore.

In conventional steam stimulation processes, during the initial production phase, much of the heat which was put into the reservoir with the steam is simply removed again and is lost. Thus, a major inefficiency of thermal stimulation processes is that this heat must be supplied during each cycle and as the available oil becomes more remote from the well, the cyclic wasted heat quantity increases.

Nevertheless, the only methods which have been proven to be effective commercially in a wide range of reservoirs are steam stimulation processes, and these processes only recover a small portion of the bitumen with rapidly declining effectiveness following each steam injection/production cycle. A continuing need exists for a steam stimulation process which will more efficiently recover oil and reduce the amount of wasted thermal energy.

SUMMARY OF THE INVENTION

In accordance with the present invention, an improved stimulation recovery process is provided which more efficiently utilizes the thermal energy contained in steam. The process utilizes pairs of wells which are connected to each other at or near the surface. Steam is injected into the reservoir via a first well and permitted to soak conventionally. Production from the first well is flowed back directly into the reservoir via the second well which is at the end of a steam stimulation cycle and is therefore ready for another steam stimulation cycle. The flowback production from the first well into the second well is terminated when the wellhead pressures have substantially equilibrated or when significant hydrocarbon production from the first well is detected. Formation fluids, including heavy oil, are then artificially lifted from the first well, and the second well is steam stimulated conventionally. The process is usually repeated in a coordinated fashion until oil production becomes uneconomical.

By utilizing this invention, the capacity of associated steam generating plants, reuse water plants and produce water disposal facility can be substantially reduced. Moreover, significant savings are realized by not having to produce an equivalent amount of steam equal in heating value to the fluid cycled from the first well to the second well.

BRIEF DESCRIPTION OF THE DRAWING

The Drawing schematically illustrates a well combination which penetrates a subterranean heavy oil formation and which is useful in practicing this invention.

DETAILED DESCRIPTION OF THE INVENTION

The present invention is an improved stimulation process for recovering normally immobile viscous oil a from subterranean formation. Unlike most steam stimulation processes which can be practiced using a single well, this invention requires at least two wells for stimulating the formation in a coordinated fashion at significantly improved efficiencies. The success or efficiency of a steam stimulation treatment is usually based on the incremental oil-steam ratio, which is the stimulated oil production minus the expected primary production divided by the amount of steam (in $m^3$) injected. Generally when this number falls below about 0.10, oil production is no longer considered to be efficient, depending on current world prices for oil. The present invention in essence reduces the amount of steam which must be generated at the surface, and significantly reduces the amount of wasted thermal energy. The efficiency of the steam stimulation process is significantly improved over conventional processes.

These benefits are achieved by connecting two steam stimulation wells at or near the surface, stimulating the formation via a first well, and flowing back produced fluids from the first well into the other well. Once pressures between both wells have become substantially equal, or significant quantities of hydrocarbons begin to appear in the production stream, the connection between the wells is closed off. Then, mobilized oil is lifted from the first well and make up steam is injected into the other well to complete the steam stimulation cycle. Fluids are then produced from the other well conventionally. Each steam injection, soak, steam flowback, and oil production cycle can be and is often repeated for a given formation. Thus, typically five to ten steam stimulation cycles will be performed.

Optionally, the initially produced fluids from the other well (mostly steam initially) can be flowed back into the first well to further stimulate production, when the economics permit. However, this latter option will not ordinarily be viable since usually the production interval of a steam stimulation cycle is significantly longer than the steam injection interval. Thus, the optional procedure would tend to introduce complications in coordinating steam injection and fluid production intervals.

The Drawing illustrates a double-well completion scheme for practicing the present invention. Wells 1 and 2 are extended from the surface 3 to the bottom of heavy oil formation 4. Each well is similarly completed. Similarly, well 1 includes a casing or liner 5 having perforation 6 (or other communication means such as slots) over the thickness of the formation 4. (For reference, components on well 2 corresponding to those on well 1 are designated with a prime (') mark. This discussion focuses on well 1, but applies to well 2 also.) A smaller diameter tubing string 7 is concentrically located within the casing 5 of each well and is terminated above the bottom of formation 4. If desired, a well packer may be employed to isolate the annular space between the tubing string 7 and the casing 5 of each well. However, the embodiment of the Drawing does not utilize such packers. The wellhead assemblies 9 and 10 of wells 1 and 2, respectively, are directly connected by means of conduit 8. Conduit 8 may be standard oil field tubing, and should be sized so that fluid pressure losses are minimized. Conventional metering devices 11 are inserted in conduit 8 to measure flow rates, steam quality and pressure, and to detect the presence of hydrocarbons.

In practice, the portion of wells 1 and 2 which penetrate formation 4 will be separated by a substantial distance, e.g. from about 125 to about 225 meters. This range is based on the typical well patterns for steam stimulating formations, e.g. 5-spot, 9-spot, etc. For these conventional patterns, the wellhead assemblies of each well will be separated by a similar distance. In this instance, the connecting conduit 8 between wells 1 and 2 will preferably be insulated to prevent undesirable heat losses to the air. Alternatively, as is the practice in many fields including Cold Lake, deviated wells are drilled. Thus, the lower portions of wells 1 and 2 may be separated by a considerable distance, while the wellheads 9 and 10 of each well may be separated by a few meters, e.g. from about 4 to about 8 meters. In the case of such deviated wells, the problems of insulating the connecting conduit 8 will be much less severe. The techniques for insulating the conduit 8 will be known to those skilled in the art.

Regardless, steps are preferably taken to minimize heat losses from the connecting conduit so that the steam flowing from well 1 to well 2 remains of relatively high quality.

In practicing the method, steam is injected into the formation via well 2, preferably at the highest practical injection rates. It is to be understood that well 2 represents just one well in an overall pattern in the field and that other wells corresponding to well 2 will also be used for injecting steam into the formation. For simplicity of description, however, this discussion focuses on only two wells of a given pattern.

Following injection of steam into well 2, the well is shut in and the formation is permitted to "soak" during which time heat is transferred from the steam to the otherwise immobile heavy oil thereby reducing its viscosity. The time period of the soaking step is generally on the order of a few days and is governed primarily by the need to strike a balance between avoiding excessive production of steam against excessive heat losses. Following the soak period, the well 2 is opened again and mobilized oil is produced back through the tubing string 7.

The fluids initially produced from the well will usually be steam and hot water. Later, the oil production rate typically approaches 4 or 5 times the original rate. The initial rate of high oil production can last anywhere from 2 months up to 6 or more months and then the rate declines sharply. Typically, over a time period ranging from about 350 to about 450 days, the oil production rate becomes uneconomic.

Shortly before another steam stimulation cycle would be initiated on well 2 (say, 30 days to 45 days), a steam stimulation cycle is initiated using well 1. Thus, steam is injected into the formation via well 1, the well is shut-in and the formation is permitted to soak as usual. Following the soak period, the well 1 is opened and the initial production is flowed directly from well 1 to well 2 via conduit 8 and into formation 4. This flowback production of fluids consists mostly of steam and some water, with traces of gases and hydrocarbons. Such trace amounts may range up to about 5% by volume, but preferably less than about 2% by volume and most preferably less than about 1% by volume. The average quality of the steam over the period of flowback may range from about 50% to about 70%, but will depend upon the quality of the steam originally injected, the stage of the steam stimulation process, the reservoir type, and other reservoir variables. In general, the average flowback steam quality will range from about 50% to about 90% of the originally injected steam quality. The fluid pressures at wellheads 9 and 10 are monitored during production from well 1 into well 2. Direct flow into well 2 is terminated when the two wellhead pressures are approximately equal, or when more than trace amounts of hydrocarbons appear in the produced fluids from well 1.

The flowback production from well 1 can be injected into well 2 through either the tubing 7' (alternative B in the Drawing) or the annulus between tubing 7' and casing 6' of well 2 (alternative A in the Drawing). Typically, fluids may flow from well 1 into well 2 for about 20 to about 30 days.

Once the wellhead pressures have approximately equilibrated (or hydrocarbons begin to appear in larger amounts), flow of fluids from well 1 into well 2 is terminated. Then, additional steam is injected into the formation via well 2 until the injection pressure approaches the formation fracture pressure. This will generally require from about 3,000 to about 8,000 $m^3$ of steam.

It has been calculated that by practicing the present invention, the quantity of steam required to steam stimulate formation 4 via well 2 can be reduced by about 20 percent to about 30 percent over what would be required without resort to the present method.

Because stimulation of formation 4 via well 2 is accomplished using steam consisting in part of the fluid production from well 1, significantly reduced amounts of steam generated at the surface are necessary. Thus, it has been calculated that a 10 to 20 percent reduction in the capacity of surface steam plants, water reuse plants and produced water disposal facilities can potentially be achieved. Significant capital cost savings are therefore possible.

In the method of the present invention, steam is utilized to thermally stimulate the hydrocarbon formation. Because of its high heat content per pound, steam is ideal for raising the temperature of a reservoir in a thermal stimulation process. Saturated steam at 175° C. (350° F.) contains about 1,190 btu per pound compared with water at 175° C. (350° F.) which has only 322 btu per pound or only about one-fourth as much as steam. The big difference in heat content between the liquid and the steam phases is the latent heat or heat of evaporation. Thus, the amount of heat that is released when the steam condenses is very large. Because of this latent heat, oil reservoirs can be heated much more effectively by steam than by either hot liquids or non-condensable gases.

Several factors affect the volume of steam injected. Among these are the thickness of the hydrocarbon-containing formtion, the viscosity of the oil, the porosity of the formation, amount of formation face exposed and the saturation level of the hydrocarbon, water in the formation and the fracture pressure. Generally, the total steam volume injected in each steam stimulation cycle will vary between about 300 and about 12,000 $m^3$. Of course, in this invention a portion of this volume is obtained from the flowback production of steam, creating significant energy savings. Pressures usually range up to about 2,000 psig, preferably no more than 1,600 psig for most reservoirs. During the oil recovery phase, pressures decline to atmospheric pressure.

Generally, in most field applications the steam will be wet with a quality of approximately 65 to 90 percent, although dry or slightly dry or slightly superheated steam may be employed. An important consideration in the choice of wet rather than dry steam is that is may be generated from relatively impure water using simple field equipment. The quantity of steam injected will vary depending on the conditions existing for a given reservoir.

Further details on steam stimulatin processes may be found in the following references: S. M. Farouq Ali, "Current Status of Steam Injection as a Heavy Oil Recovery Method", Journal of Canadian Petroleum Technology, Jan.-Mar., 1974; G. H. Kendall, "Importance of Reservoir Description in Evaluating In Situ Recovery Method for Cold Lake Heavy Oil, Part I—Reservoir Description", The Petroleum Society of C.I.M., Paper No. 7620, presented at the 27th Annual Technical Meeting in Calgary, June 7-11, 1976; D. E. Towson, "Importance of Reservoir Description in Evaluating In Situ Recovery Methods for Cold Lake Heavy Oil, Part II—In Situ Application", Petroleum Society of C.I.M., Paper No. 7621, presented at the 26th Annual Technical Meeting in Calgary, June 7-11, 1976.

FIELD EXAMPLE

The method of the present invention was tested on a Cold Lake heavy oil reservoir. A pair of deviated wells were utilized (for convenience hereinafter referred to as wells 1 and 2). It was estimated that the end of well 1 was separated from the end of well 2 by from about 175 to about 220 meters, while respective wellheads were separated by about 5 meters. The respective wellheads were connected by means of conventional oil field tubing, I.D. 2". A test separator was installed in the connector tubing to monitor the steam quality and to insure that significant quantities of hydrocarbons were not flowed from one well to the other. In normal commercial operations, such a separator would not be required or preferred since it places some pressure limitations on flowing fluid from well 1 to well 2. As a consequence of the pressure limitations in the field test, flowback production was required for 24 days as opposed to an ordinary period of perhaps from about 10 to about 14 days.

Approximately 11,000 $m^3$ of about 80 percent quality steam were injected into well 1 over a 47 day period.

The well 1 was shut-in and permitted to soak for about 2 days. Well 2, which had been previously utilized in a steam stimulation cycle and was in a declining oil production phase, was ready for another steam stimulation cycle. The production fluids from well 1 were flowed back via the connecting pipe into well 2 and into the formation. The flowback process lasted for 24 days with about 2245 $m^3$ of 70% average steam quality steam being flowed back from well 1 and injected into the formation via well 2. This amount of steam was about 23% of the total amount of steam originally injected into well 1.

The amount of hydrocarbons gases produced with the steam was determined to be negligible, on the order of 0.2 to about 1.7% of the steam vapor volume.

At the end of the 24 day flowback period, the steam pressures at the wellheads of wells 1 and 2 had approximately equilibrated at 320 psi. An additional quantity of steam equal to 8,000 $m^3$ of 80 percent quality steam was then injected into well 2 at a rate of 220 $m^3$/day. Production liquids were then lifted from well 1 conventionally and, after permitting the steam injected via well 2 to soak, formation fluids were produced from well 2.

Based on this field test, it is estimated that about 24% savings in the amount of steam required to be generated at the surface is realized. The advantages of this invention should be apparent with this example.

Various modifications and alterations in the practice of this invention and in particular in the arrangement of the connected wells should be apparent to those skilled in the art without departing from the scope and spirit of this invention. It should be understood that the invention claimed here should not be unduly limited to the specific example or embodiment said forth herein.

What I claim is:

1. A steam stimulation process for enhancing the production of viscous hydrocarbons from a subterranean formation penetrated by at least first and second wells which comprises:
   (a) connecting said first and second wells with each other by a conduit at or near the surface;
   (b) injecting steam into the formation via said first well, permitting the formation to soak, and producing fluids including mobilized viscous hydrocarbons from said first well until the production rate substantially declines;
   (c) injecting steam into said second well and permitting said formation to soak;
   (d) producing fluids consisting essentially of steam and hot water from said second well and flowing said fluids into said formation via said conduit and said first well;
   (e) terminating step (d) when fluid pressures of said first and second wells have substantially equilibrated or when more than trace amounts of hydrocarbons are produced;
   (f) injecting an additional quantity of steam into said formation via said second well, permitting said formation to soak, and producing fluids from both said first and second wells.

2. The method of claim 1 which comprises repeating steps (b)–(f) in a coordinated fashion until hydrocarbon production is no longer economic.

3. A method for recovering viscous oil from a subterranean deposit penetrated by at least two wells which comprises:
   (a) connecting said wells by means of a conduit;
   (b) injecting steam into said deposit via one well sufficient to mobilize viscous oil, and producing fluids including said mobilized viscous oil via said one well;
   (c) injecting steam into said deposit via the other well sufficient to mobilize said viscous oil and producing fluids consisting essentially of steam and hot water via said other well;
   (d) flowing the fluids produced in step (c) into said deposit via said conduit and said one well;
   (e) terminating the flow of fluids between said wells when the fluid pressure in said one well substantially equals the fluid pressure in said other well, or when more than trace amounts of mobilized viscous oil are produced via said other well;
   (f) injecting an additional amount of steam into said one well to assist in mobilizing said viscous oil;
   (g) producing mobilized viscous hydrocarbons from both of said wells.

4. The method of claim 3 wherein said wells are deviated wells.

5. The method of claim 3 wherein the lower portions of said wells are separated by about 125 to 225 meters.

6. The method of claim 3 wherein said conduit is no more than about 8 meters in length.

7. The method of claim 3 wherein said conduit is insulated.

8. A process for producing viscous hydrocarbons from a subterranean hydrocarbon reservoir which is penetrated by at least two wells connected by a conduit at the surface which comprises:
   (a) steam stimulating the reservoir in the vicinity of one of said wells;
   (b) steam stimulating the reservoir in the vicinity of the other well by:
      (i) producing fluids consisting essentially of steam and hot water from said one well directly into said other well and into said reservoir;
      (ii) terminating step (i) when fluid pressure in said wells equilibrate or when more than trace quantities of hydrocarbons are produced via said one well;
      (iii) injecting an additional quantity of steam into the reservoir via said other well to complete the steam stimulation of the reservoir in the vicinity of said other well;
   (c) producing hydrocarbons mobilized by steps (a) and (b) via said wells.

9. The process of claim 8 wherein the reservoir has already undergone at least one previous steam stimulation cycle via said other well and further comprising initiating step (a) shortly before said previous steam stimulation cycle has been completed.

10. The process of claim 8 wherein from about 300 $m^3$ to about 12,000 $m^3$ of steam are injected in step (a) and from about 3,000 $m^3$ to about 8,000 $m^3$ of steam are injected into the reservoir in step (b)(iii).

11. A method for recovering viscous hydrocarbons from a subterranean formation penetrated by first and second wells connected at or near the surface by a conduit which comprises:
   (a) injecting steam into said formation through said first well and permitting the steam to soak therein;
   (b) producing fluids consisting essentially of steam and hot water from the formation through said first well and flowing said fluids directly into said formation via said conduit and said second well, said second well having been previously used to inject steam into said formation and having substantially ceased producing fluids following a soak period;

(c) injecting an additional amount of steam into said formation via said second well; and (d) producing fluids including viscous hydrocarbons from said formation through said second well.

12. The method of claim 11 wherein fluids are flowed into said second well until pressures in said first and second wells substantially equilibrate, or until significant quantities of hydrocarbons are produced, whichever occurs first.

* * * * *